US009968505B2

(12) United States Patent
Leier et al.

(10) Patent No.: US 9,968,505 B2
(45) **Date of Patent: *May 15, 2018**

(54) MASSAGE DEVICE FOR TILTING INVERSION EXERCISER

(71) Applicants: Expectations, LLC, Puyallup, WA (US); Beto Engineering & Marketing Co., Ltd., Taichung (TW)

(72) Inventors: Christopher Henry Leier, Taichung, WA (US); Howard Paul Schultz, Puyallup, WA (US); Lo Pin Wang, Taichung (TW)

(73) Assignees: Expectations, LLC, Puyallup, WA (US); Beto Engineering & Marketing Co., Ltd., Beitun, Taichung (TW)

( * ) Notice: Subject to any disclaimer, the term of this patent is extended or adjusted under 35 U.S.C. 154(b) by 229 days.

This patent is subject to a terminal disclaimer.

(21) Appl. No.: 14/159,654

(22) Filed: Jan. 21, 2014

(65) Prior Publication Data

US 2015/0202110 A1 Jul. 23, 2015

(51) Int. Cl.
*A61H 1/00* (2006.01)
*A61H 1/02* (2006.01)
(Continued)

(52) U.S. Cl.
CPC ..... *A61H 1/0218* (2013.01); *A61H 1/003* (2013.01); *A61H 1/0222* (2013.01); *A61H 1/0229* (2013.01); *A61H 7/001* (2013.01); *A63B 21/0023* (2013.01); *A63B 21/00054* (2013.01); *A63B 21/068* (2013.01);
(Continued)

(58) Field of Classification Search
CPC ..... A61H 1/00; A61H 1/0218; A61H 1/003; A61H 1/0222; A61H 1/0229; A61H 7/001; A61H 2201/0192; A61H 2201/1261; A61H 2201/1284; A61H 2201/1642; A61H 2201/168; A61H 2201/1695; A61H 39/04; A61H 2203/0493; A61H 2205/081; A63B 21/00; A63B 21/00054; A63B 21/4035; A63B 21/4013; A63B 21/4031; A63B 21/4047; A63B 21/068; A63B 21/0023;
(Continued)

(56) References Cited

U.S. PATENT DOCUMENTS 3,388,700 A * 6/1968 Mountz ..... A61H 1/0218 482/144
3,707,734 A * 1/1973 Matthews ..... A61G 1/01 5/627

(Continued)

*Primary Examiner* — Quang D Thanh
(74) *Attorney, Agent, or Firm* — Charles E. Baxley

(57) ABSTRACT

A tilting inversion exerciser includes a carrier pivotally attached to a supporting stand for mounting a supporting table and for supporting a user, the supporting table includes a number of grooves, and a massage member is engaged with either of the grooves of the supporting table for attaching to the supporting table and for selectively engaging with the user to selectively massage the user. The massage member includes a catch engageable through the grooves of the supporting table for attaching to the supporting table, the catch is coupled to the massage member with a reduced neck member. The catch includes a length (L) greater than the width (D) of the grooves of the supporting table for engaging with the supporting table.

10 Claims, 10 Drawing Sheets

(51) Int. Cl.

| | |
|---|---|
| ***A61H 7/00*** | (2006.01) |
| ***A63B 21/068*** | (2006.01) |
| ***A63B 21/00*** | (2006.01) |
| ***A63B 21/002*** | (2006.01) |

(52) U.S. Cl.
CPC ..... *A63B 21/4013* (2015.10); *A63B 21/4015* (2015.10); *A63B 21/4031* (2015.10); *A63B 21/4035* (2015.10); *A63B 21/4047* (2015.10); *A61H 2201/0192* (2013.01); *A61H 2201/1261* (2013.01); *A61H 2201/1284* (2013.01); *A61H 2201/168* (2013.01); *A61H 2201/1642* (2013.01); *A61H 2201/1695* (2013.01); *A63B 2208/0271* (2013.01); *A63B 2208/0285* (2013.01); *A63B 2213/00* (2013.01)

(58) Field of Classification Search
CPC .... A63B 2208/0271; A63B 2208/0285; A63B 2213/00; A63B 21/4015
See application file for complete search history.

(56) References Cited

U.S. PATENT DOCUMENTS

| | | | | |
|---|---|---|---|---|
| 7,036,167 | B2 * | 5/2006 | Tomcany | A61F 5/3707 128/870 |
| 7,052,448 | B2 | 5/2006 | Teeter | |
| 7,361,128 | B2 | 4/2008 | Chen | |
| 8,556,787 | B2 * | 10/2013 | Leier | A61H 1/0222 482/144 |
| 2004/0243037 | A1 | 12/2004 | Zapalac et al. | |
| 2005/0015031 | A1 | 1/2005 | Lin | |
| 2006/0063654 | A1 | 3/2006 | Kuo | |
| 2007/0298948 | A1 * | 12/2007 | Chen | A61H 1/0218 482/144 |
| 2008/0086066 | A1 | 4/2008 | Munday | |
| 2008/0227610 | A1 * | 9/2008 | Chen | A61H 1/0218 482/143 |
| 2009/0054217 | A1 * | 2/2009 | Teeter | A61H 1/0218 482/144 |

* cited by examiner

MASSAGE DEVICE FOR TILTING INVERSION EXERCISER

The present invention is a continuation-in-part of U.S. patent application Ser. No. 13/199,561, filed: 2 Sep. 2011, pending and to be abandoned.

BACKGROUND OF THE INVENTION

1. Field of the Invention

The present invention relates to a tilting inversion exerciser, and more particularly to a tilting inversion exerciser including a massage device or mechanism for massaging the back portions of the user in addition to the rotational exercises.

2. Description of the Prior Art

Various kinds of typical inversion suspension exercisers, rotational exercisers, tilting inversion exercisers etc. have been developed and comprise a table rotatably or pivotally attached to an upper portion of a lower or base support with a pivot axle, and rotatable relative to the base support for conducting various inversion or suspension exercises.

For example, U.S. Pat. No. 7,052,448 to Teeter, and U.S. Pat. No. 7,361,128 to Chen disclose two of the typical inversion suspension exercisers each comprising a table rotatably or pivotally attached to a base support with a hanger bar, for allowing the users to rotate the table relative to the base support, and to do various inversion or suspension exercises.

However, the table of the typical inversion suspension exercisers may only be used to support the back portions of the users, and the typical inversion suspension exercisers do not have any massage members or devices to massage the back portions of the users, such that the users may use the conventional tilting inversion exercisers to conduct only the rotational or inversion exercises.

U.S. Patent Application No. 2006/0063654 to Kuo discloses another typical inversion suspension exerciser comprising a table rotatably or pivotally attached to a base support with a hanger bar, for allowing the users to rotate the table relative to the base support, and to do various inversion or suspension exercises.

However, Kuo failed to disclose that the supporting table includes a plurality of grooves formed therein, and further failed to disclose a massage member engaged with either of said grooves of said supporting table for attaching to said supporting table and for selectively engaging with the user to selectively massage the user.

U.S. Patent Application No. 2008/0086066 to Munday discloses a further typical inversion suspension exerciser comprising a massage device wherein massage members engage with grooves for attaching to the massage device and for selectively engaging with the user to selectively massage the user, and further teaches that the use of removable massage members allows for massage members of different sizes and shapes to be interchangeably attached in order to apply a desired amount of pressure to the user during the massage.

However, Munday failed to disclose that the supporting table includes a plurality of grooves formed therein, and a massage member engaged with either of said grooves of said supporting table, the massage device may not be acted or used as a supporting table attached to a carrier for supporting a user thereon, and the palm attachments, the muscle grabber attachments, and the thumb attachments may not be acted or used as a supporting table attached to a carrier for supporting a user thereon.

U.S. Patent Application No. 2004/0243037 to Zapalac et al. discloses a typical massage device comprising a plurality of massage members for engaging with and for massaging the user manually.

However, Zapalac et al. failed to disclose that a supporting table includes a plurality of grooves formed therein for engaging with massage members and for attaching to said supporting table and for selectively engaging with the user to selectively massage the user.

U.S. Patent Application No. 2005/0015031 to Lin discloses a further typical massage device comprising a plurality of rotatable massage members for engaging with and for massaging the user manually.

However, the massage members are solidly and stably secured and retained in a frame member and may not be easily moved to the other position or location of the frame member, and thus may not be used for massaging various portions of the user.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a massage device or mechanism for massaging the back portions of the user in addition to the rotational exercises.

In accordance with one aspect of the invention, there is provided a tilting inversion exerciser comprising a supporting stand, a carrier pivotally attached to the supporting stand with a bearing support, a supporting table attached to the carrier for supporting a user thereon, the supporting table including a plurality of grooves formed therein, and a massage member engaged with either of the grooves of the supporting table for attaching to the supporting table and for selectively engaging with the user to selectively massage the user, the massage member including a catch extended outwardly therefrom and engageable through the grooves of the supporting table for attaching to the supporting table, the catch including a width (W) no greater than a width (D) of the grooves of the supporting table for engaging through the grooves of the supporting table, and the catch including a length (L) greater than the width (D) of the grooves of the supporting table for engaging with the supporting table when the catch is rotated relative to the supporting table, the massage member including a reduced neck member coupled to the catch, and the massage member including at least one cavity formed therein for increasing a softness of the massage member and for softly contacting and engaging with the back portion of the user.

The massage member includes at least one projection extended outwardly therefrom for selectively engaging with the supporting table and for solidly and stably anchoring or positioning the massage member to the supporting table and for preventing the massage member from moving or sliding relative to the supporting table.

The supporting table includes a primary table plate and an auxiliary table plate attached to the carrier for supporting different portions of the user. The primary table plate and the auxiliary table plate each include a plurality of the grooves formed therein for selectively engaging with the massage member at different portions of the table plates.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
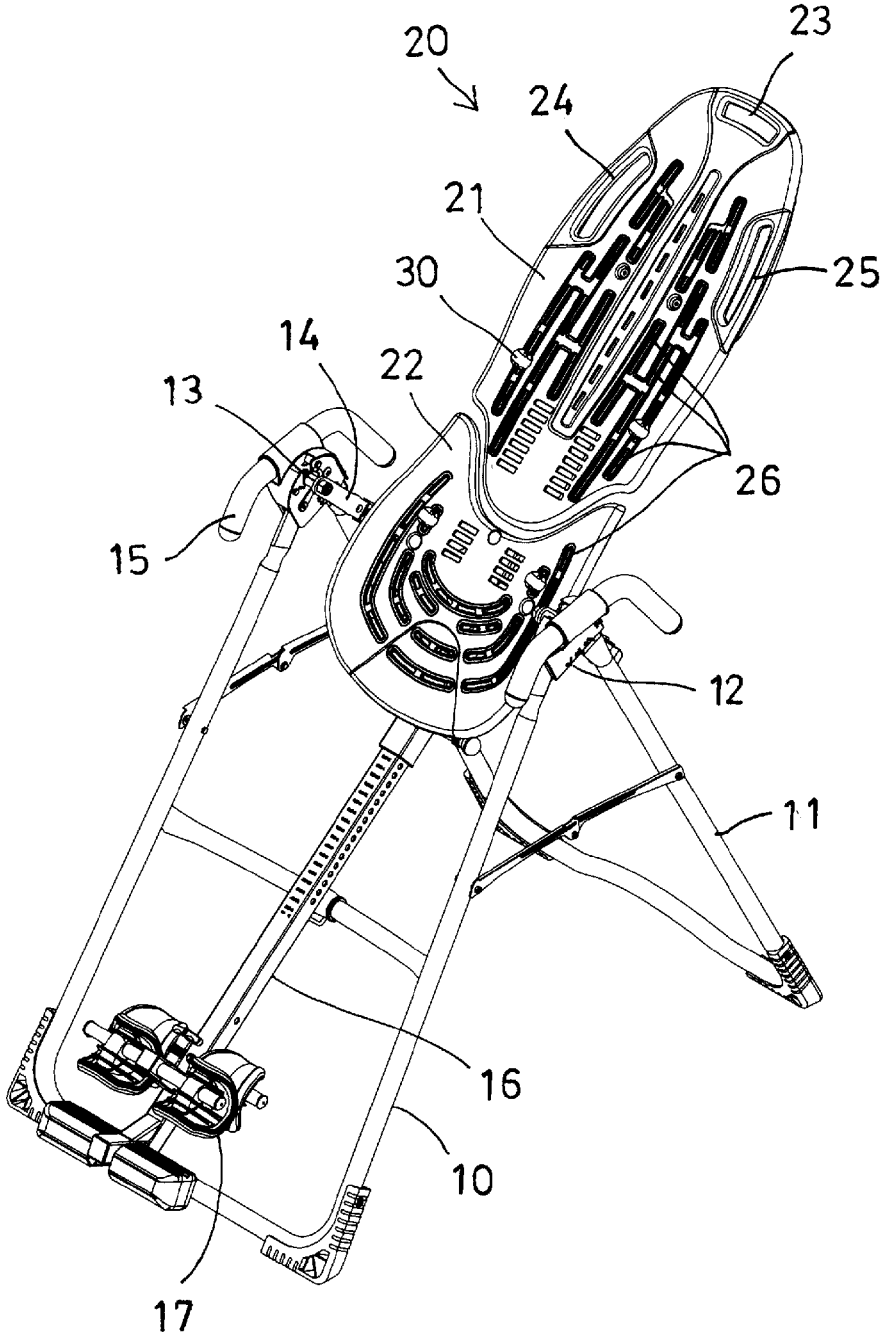
FIG. 1 is a perspective view of a tilting inversion exerciser in accordance with the present invention.
Figure 2:
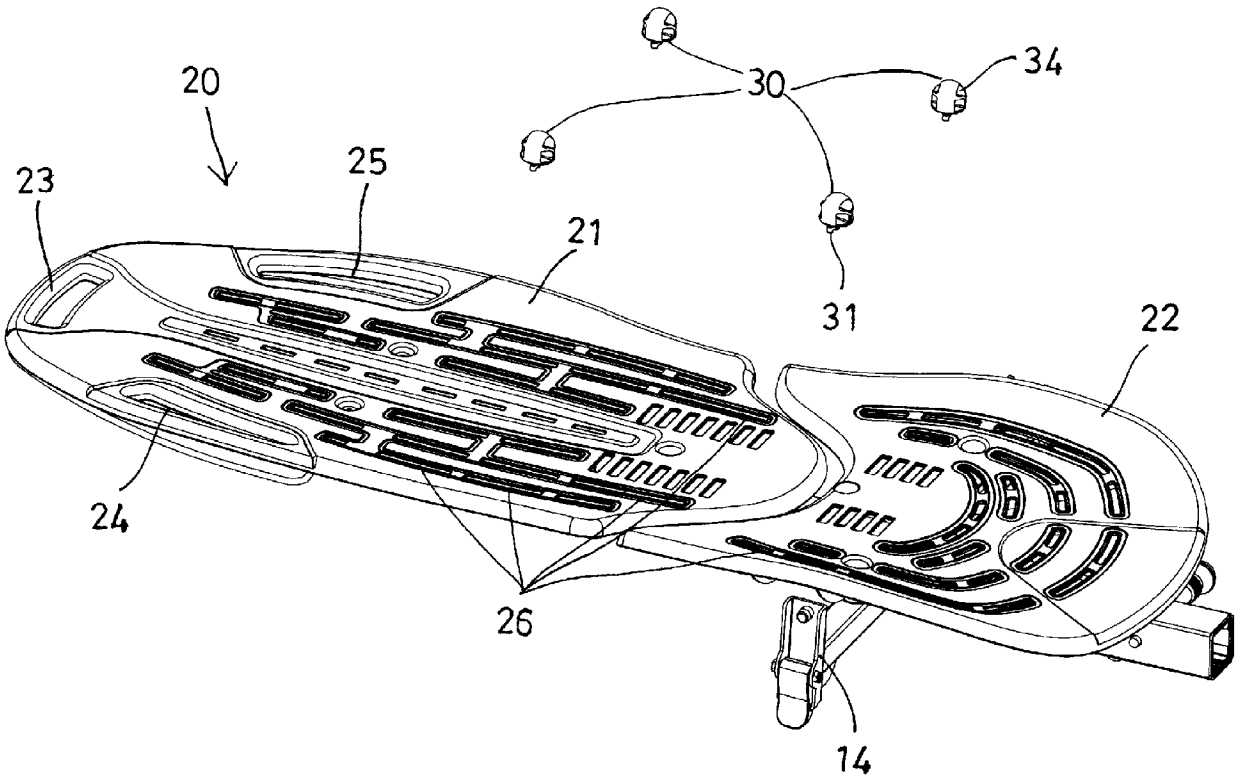
FIG. 2 is a partial exploded view of the tilting inversion exerciser.
Figure 3:
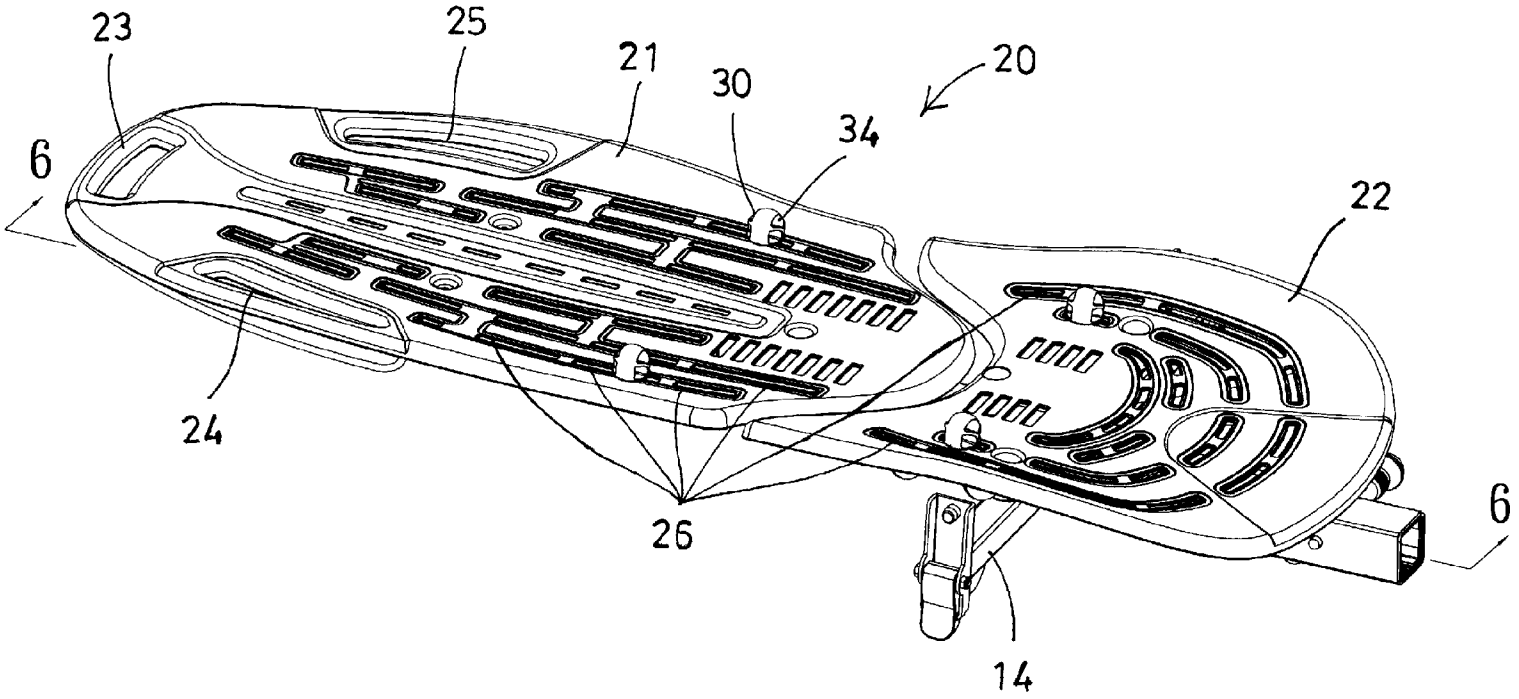
FIG. 3 is an upper perspective view illustrating a supporting table of the tilting inversion exerciser.
Figure 4:
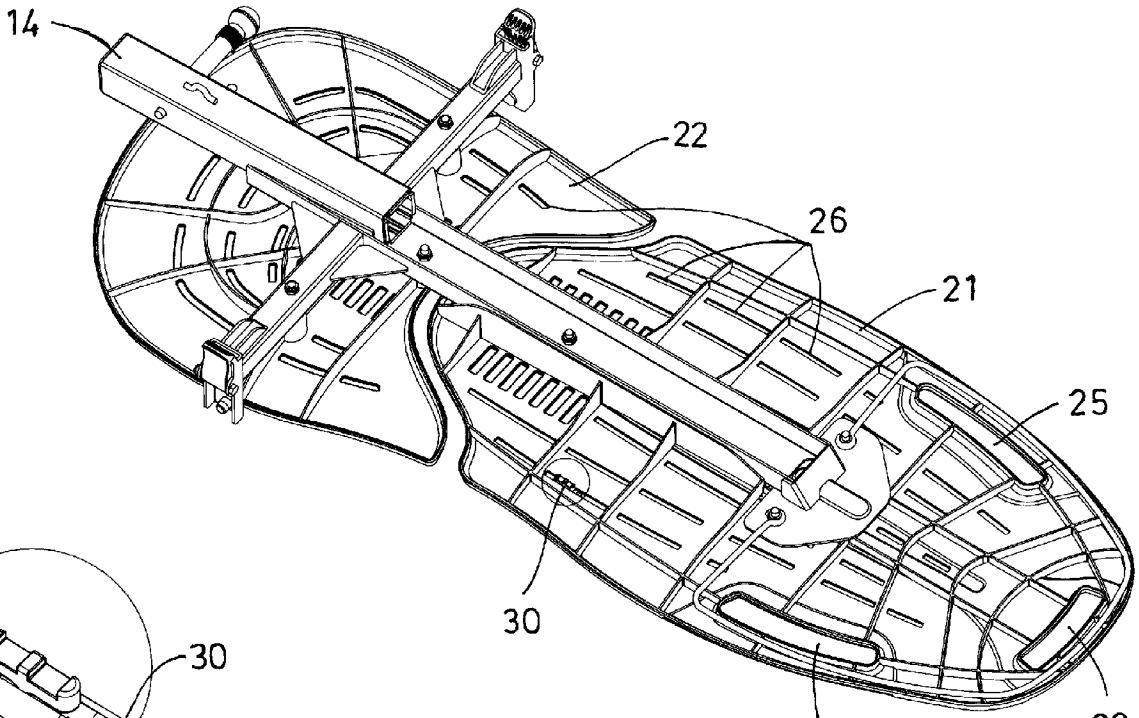
FIG. 4 is a bottom perspective view of the supporting table.
Figure 5:
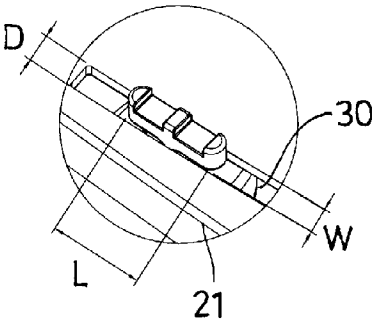
FIG. 5 is an enlarged partial perspective view of the supporting table.
Figure 7:
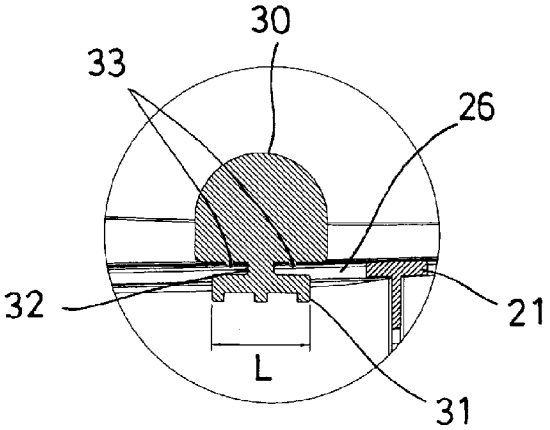
FIG. 7 is an enlarged partial cross sectional view of the tilting inversion exerciser.
Figure 6:
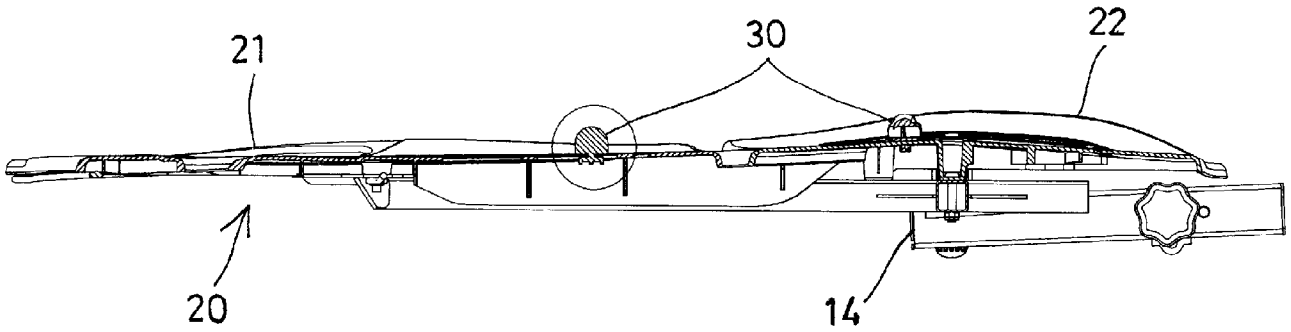
FIG. 6 is a partial cross sectional view of the tilting inversion exerciser taken along lines 6-6 of FIG. 3.
Figure 8:
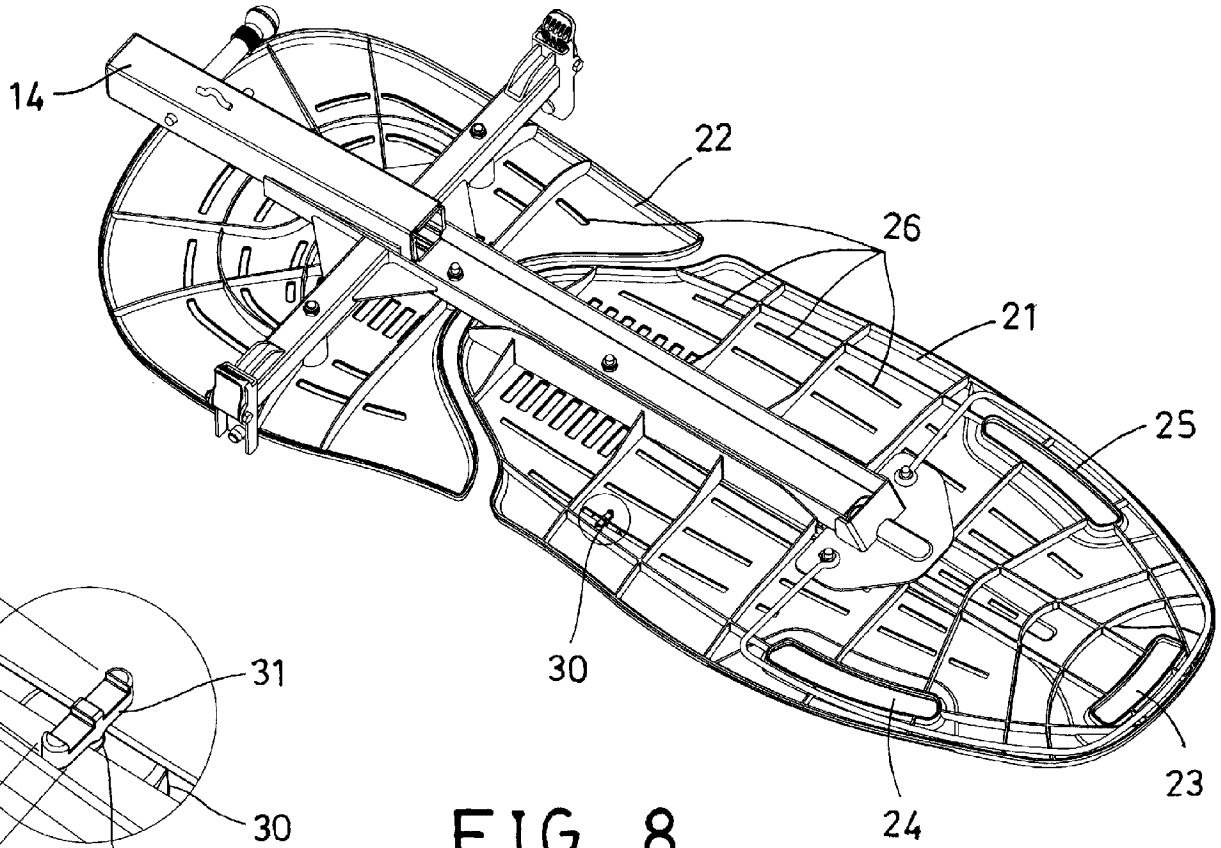
FIG. 8 is a bottom perspective view similar to FIG. 4, illustrating the operation of the tilting inversion exerciser.
Figure 9:
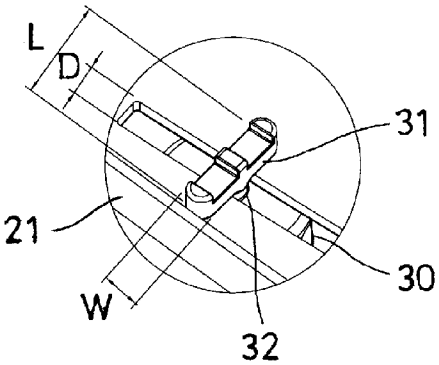
FIG. 9 is an enlarged partial perspective view of the supporting table as shown in FIG. 8.
Figure 11:
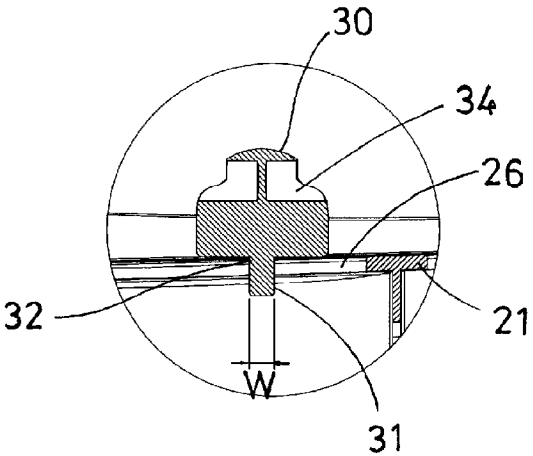
FIG. 11 is an enlarged partial perspective view of the supporting table as shown in FIG. 10.
Figure 10:
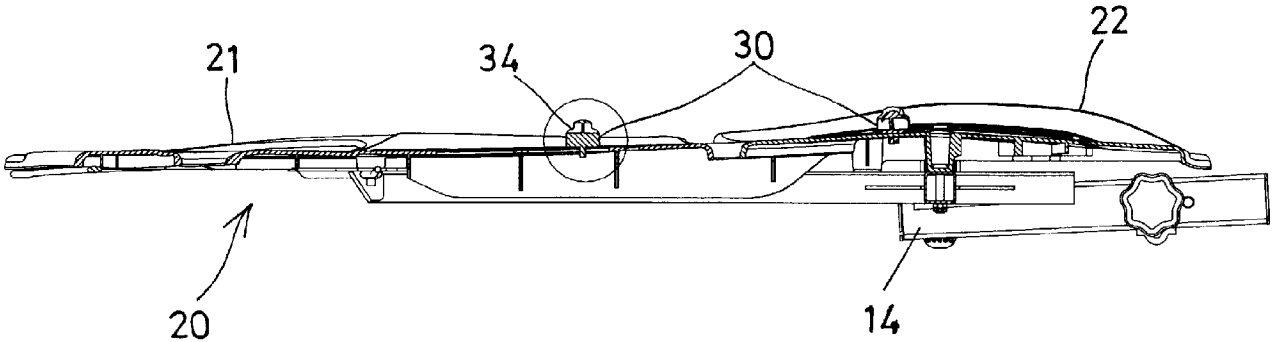
FIG. 10 is a partial cross sectional view similar to FIG. 6, illustrating the operation of the tilting inversion exerciser.

Referring to the drawings, and initially to FIGS. 1 and 12-14, a tilting inversion exerciser in accordance with the present invention comprises a lower supporting stand 10 for pivotally or rotatably supporting a base or table 20 thereon, and for supporting a user 8 on the supporting table 20 (FIGS. 13-14), the lower supporting stand 10 includes such as two U-shaped frames 11 having upper ends pivotally coupled together with two apex members 12 so as to form a substantially inverted V-shaped structure (FIGS. 1 and 12-14), and for allowing the frames 11 of the supporting stand 10 to be folded and supported between an opened working position and a folded or compact storing position. The lower supporting stand 10 includes a joint or bearing support 13 and/or a bracket or carrier 14 disposed or attached to each of the apex members 12 for pivotally or rotatably supporting or coupling the supporting table 20.

The lower supporting stand 10 includes one or more, such as two hand grips 15 formed or provided thereon, such as formed or provided on the apex members 12 respectively for being held or grasped or gripped by the user 8. The carrier 14 includes an extension 16, such as an adjustable extension 16 attached or coupled or extended from the lower portion thereof for supporting an ankle holder or foot retaining device 17 and for holding or retaining or positioning the feet of the user 8 to the carrier 14 and the supporting table 20. The extension 16 may be extended or adjusted relative to the supporting table 20 for moving or adjusting the foot retaining device 17 toward or away from the supporting table 20, according to the height of the user, for example. The above-described structure or configuration for the tilting inversion exerciser, including the lower supporting stand 10 and the carrier 14 and the hand grips 15 and the foot retaining device 17 is typical and is not related to the present invention and will not be described in further details.

The supporting table 20 includes two table plates 21, 22, such as a primary table plate 21 and an auxiliary table plate 22 attached or mounted or secured to the carrier 14 for supporting the user 8 thereon, for example, the table plates 21, 22 may include different shapes or contours or configurations and may be made of different materials for comfortably supporting different portions of the user 8, for example, the primary table plate 21 may be made of softer or resilient materials for comfortably supporting the back or the upper portion of the user 8. The primary table plate 21 may further include one or more hand grips 23, 24, 25 formed or provided thereon for being held or grasped or gripped by the user 8 (FIGS. 13-14), particularly while conducting or operating the rotational or tilting inversion exercises.

The supporting table 20 further includes a number of slots or channels or grooves 26 formed or provided in either or both of the table plates 21, 22 for attaching or mounting or securing one or more massage devices or members 30 to either or both of the table plates 21, 22. As shown in FIGS. 2-11, the massage members 30 each include a catch 31 extended outwardly therefrom and connected or coupled to the massage member 30 with a reduced neck portion or member 32, in which the diameter or the width (W) of the catch 31 and of the neck member 32 is equal to or slightly smaller than or no greater than the width (D) of the grooves 26 of the table plates 21, 22 for allowing the catch 31 and the neck member 32 to be engaged into or through the grooves 26 of the table plates 21, 22 (FIGS. 4-7) and for allowing the neck member 32 to be engaged and retained in the grooves 26 of the table plates 21, 22.

The length (L) of the catch 31 is greater than the width (D) of the grooves 26 of the table plates 21, 22 for allowing the catch 31 to be engaged with the table plates 21, 22 and to be anchored or secured or retained to the table plates 21, 22 when the catch 31 is rotated for about ninety (90) degrees relative to the table plates 21, 22 (FIGS. 8-11). It is preferable that the massage members 30 each include one or more projections 33 extended outwardly therefrom (FIG. 7) for selectively engaging with the table plates 21, 22 and for solidly and stably anchoring or securing or retaining the massage members 30 to the table plates 21, 22. It is further preferable that the massage members 30 each further include one or more notches or emptinesses or cavities 34 formed therein (FIGS. 10-11) for weight reducing purposes or for increasing the softness or the resilience of the massage members 30. The massage members 30 may be easily and quickly and readily attached or mounted or secured to various locations of the table plates 21, 22 (FIGS. 1, 12) for engaging with and for comfortably massaging various portions of the user 8, particularly while conducting or operating the rotational or tilting inversion exercises.

Figure 12:
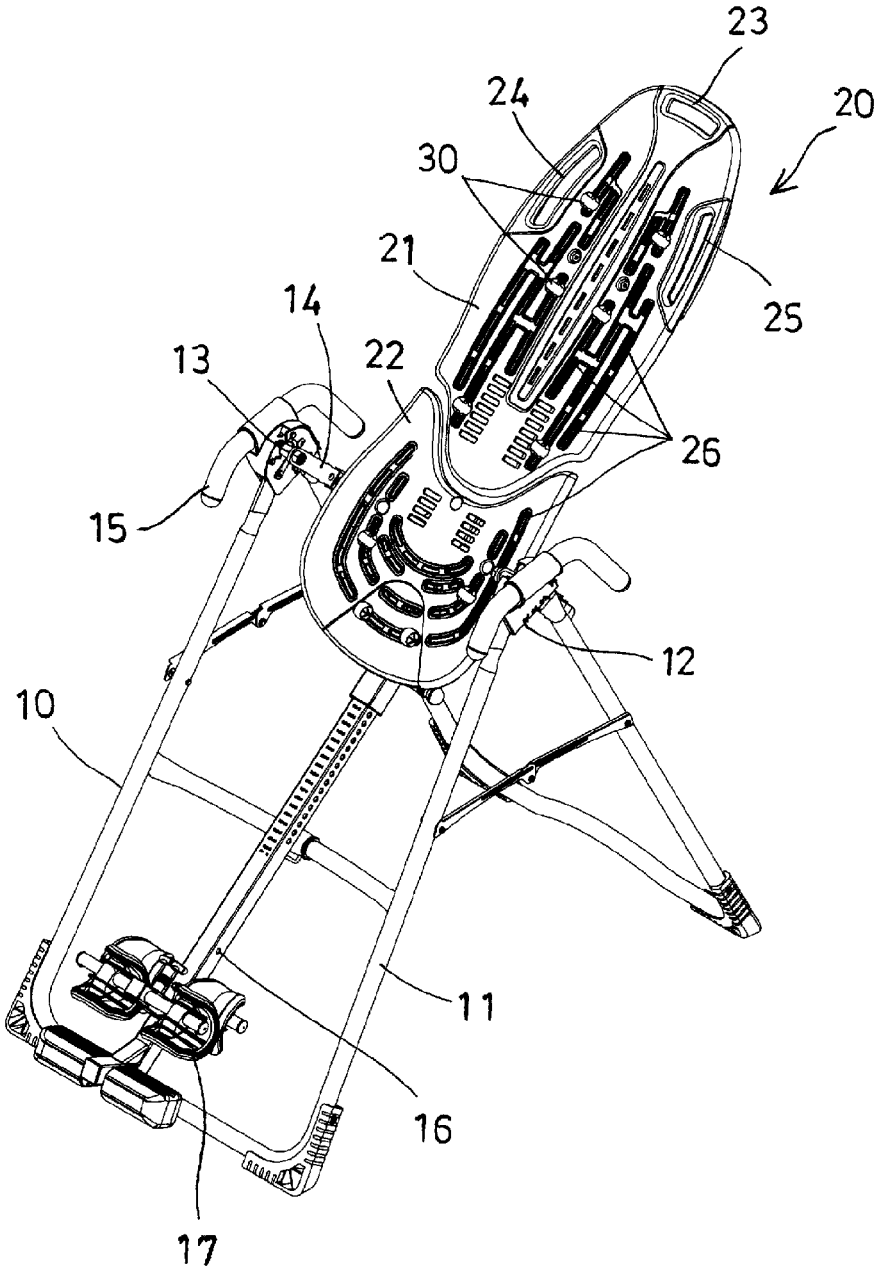
FIG. 12 is a perspective view similar to FIG. 1, illustrating the other arrangement of the tilting inversion exerciser.
Figure 13:
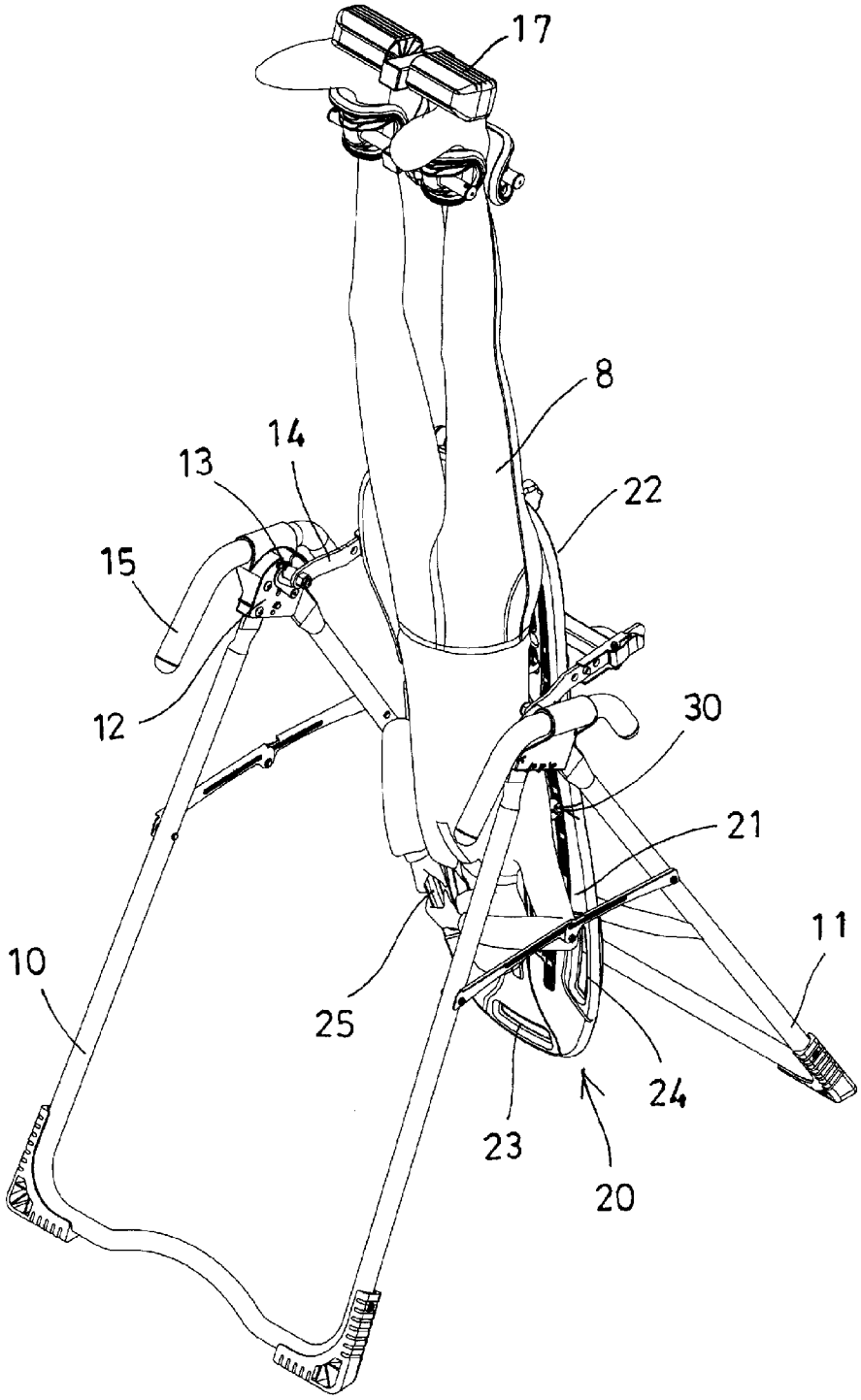
FIGS. 13, 14 are perspective views illustrating the operation of the tilting inversion exerciser.
Figure 14:
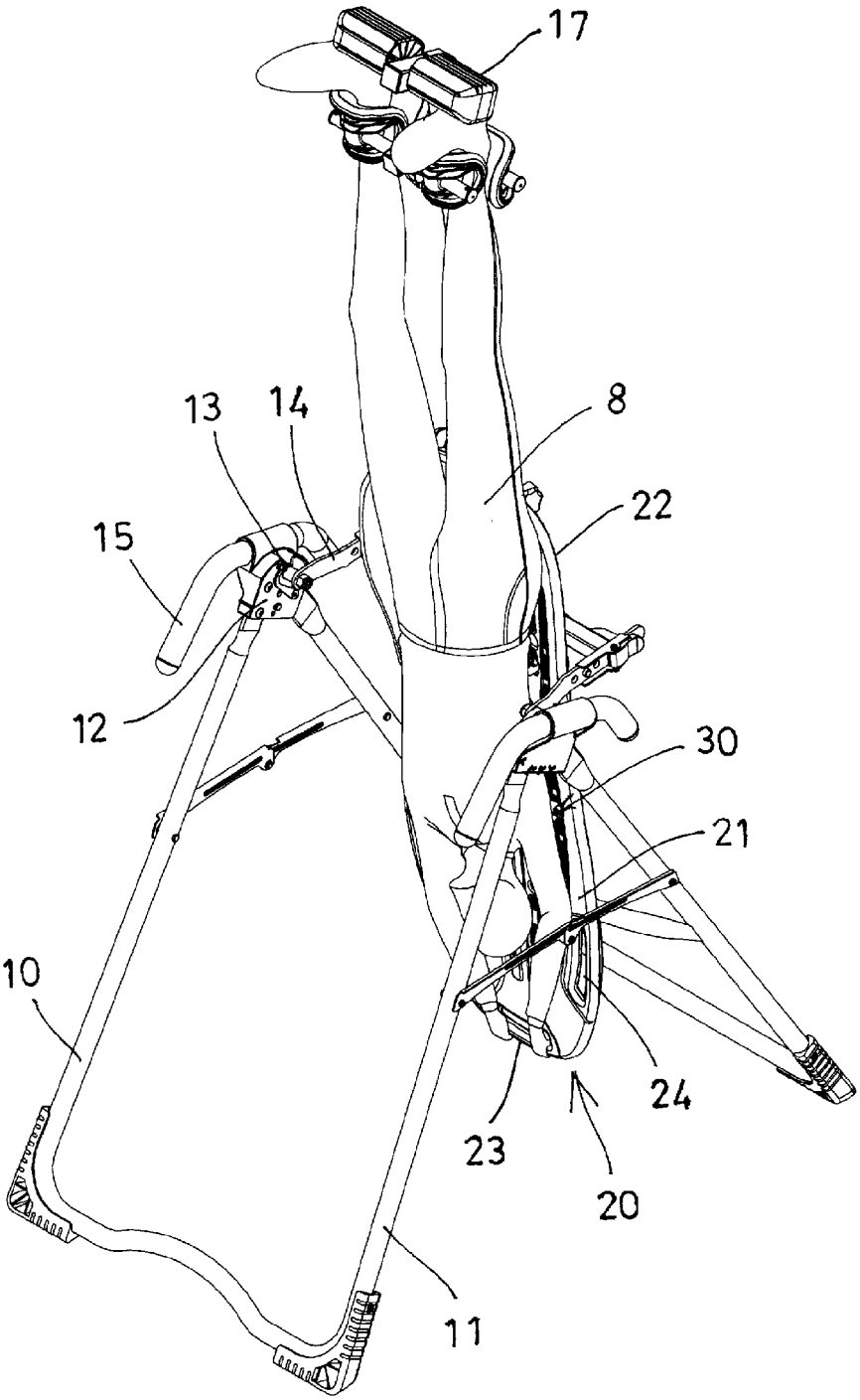

In operation, as shown in FIGS. 1 and 12, the massage members 30 may be easily and quickly and readily attached or mounted or secured to various locations of the table plates 21, 22 by engaging or inserting the catch 31 and the neck member 32 into or through the grooves 26 of the table plates 21, 22, and when the catch 31 is rotated for about ninety (90) degrees relative to the table plates 21, 22, best shown in FIGS. 8-11, the catch 31 may be engaged with the table plates 21, 22 and the massage member 30 may be anchored or secured or retained to the table plates 21, 22 for engaging with and for comfortably massaging various portions of the user 8.

Accordingly, the tilting inversion exerciser in accordance with the present invention includes a massage device or mechanism for massaging the back portions of the user in addition to the rotational exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An inversion apparatus that supports a user in an inverted position relative to an underlying floor surface, comprising:

a supporting stand sized and configured to occupy a stable position on the underlying floor surface;

a supporting table rotatably mounted on the supporting stand for rotation about a horizontal axis, wherein the supporting table defines a slot and a back engaging surface, and the back engaging surface faces toward and directly engages the user's back during use of the inversion apparatus;

a massage member secured to the supporting table via the slot to project outward from the back engaging surface and into direct contact with a proximate portion of the user's back during use of the inversion apparatus; and wherein the massage member includes:

a neck member disposed inside the slot, a catch connected to a first end of the neck member, and a user engaging portion connected to a second end of the neck member, wherein the catch is selectively rotatable relative to the supporting table ninety degrees between a first orientation: wherein the neck member occupies the slot while the catch is movable through the slot, and a second orientation: wherein the neck member occupies the slot while the catch overlaps portions of the supporting table.

2. The inversion apparatus as claimed in claim 1, wherein the supporting table extends from a foot end to a head end, and further comprising a foot retaining device connected to the supporting table proximate the foot end.

3. The inversion apparatus as claimed in claim 1, wherein the neck member is sized and configured to occupy the slot with the portions of the supporting table sandwiched between the user engaging portion and the catch.

4. The inversion apparatus as claimed in claim 1, wherein the neck member interconnected in series between the catch and the user engaging portion, and the massage member is selectively secured to the supporting table with the portions of the supporting table sandwiched between the user engaging portion and the catch.

5. The inversion apparatus as claimed in claim 4, wherein the neck member is integrally interconnected between the catch and the user engaging portion, and in the first orientation, the catch is free to move through the slot, and in the second orientation, the catch resists movement of the catch through the slot.

6. The inversion apparatus of claim 1, wherein the massage member includes at least one outwardly opening cavity formed therein.

7. The inversion apparatus as claimed in claim 1, wherein the supporting table includes a first table plate and a second table plate, and the second table plate is spaced apart from the first table plate, and each said table plate is configured and arranged to support a proximate portion of the user's back when the user is lying supine on the supporting table, and a first said massage member is secured to the first table plate to project outward from a respective back engaging surface defined thereby and directly engage and massage a respective proximate portion of the user's back, and a second said massage member is secured to the second table plate to project outward from a respective back engaging surface defined thereby and directly engage and massage a respective proximate portion of the user's back.

8. The inversion apparatus as claimed in claim 1, wherein the supporting table is made of resilient material.

9. The inversion apparatus as claimed in claim 1, wherein the slot defines a plurality of locations along the slot for receiving the massage member.

10. The inversion apparatus of claim 1, wherein the massage member is a single, unitary part.

* * * * *